US006009790A

United States Patent [19]

Tekorius

[11] Patent Number: 6,009,790

[45] Date of Patent: Jan. 4, 2000

[54] SINGLE-USE, BULLET-PROOF SHIELD

[76] Inventor: Paul Tekorius, 19425 S. Daybreak Ct., Oregon City, Oreg. 97045

[21] Appl. No.: 09/243,570

[22] Filed: Feb. 3, 1999

Related U.S. Application Data

[60] Provisional application No. 60/073,557, Feb. 3, 1998, abandoned.

[51] Int. Cl.[7] ..... F41H 5/04

[52] U.S. Cl. ..... 89/36.02; 273/403; 273/404; 273/408; 273/410; 273/409

[58] Field of Search ..... 89/36.02, 36.04, 89/36.05; 109/49.5; 273/394, 403, 404, 407, 408, 409, 410

[56] References Cited

U.S. PATENT DOCUMENTS

| | | | |
|---|---|---|---|
| H1061 | 6/1992 | Rozner et al. | 89/36.02 |
| 3,232,017 | 2/1966 | Prusinski et al. | 89/36.02 |
| 3,630,814 | 12/1971 | Arnold | 109/80 |
| 4,198,454 | 4/1980 | Norton | 428/117 |
| 4,445,693 | 5/1984 | Angwin | 273/404 |
| 4,821,620 | 4/1989 | Cartee et al. | 89/36.02 |
| 4,822,657 | 4/1989 | Simpson | 428/69 |
| 4,846,043 | 7/1989 | Langsam | 89/1.1 |
| 4,856,791 | 8/1989 | McQuade | 273/410 |
| 5,273,607 | 12/1993 | O'Scanlon | 89/36.05 |
| 5,326,606 | 7/1994 | Labock | 428/49 |
| 5,402,703 | 4/1995 | Drotleff | 89/36.02 |

FOREIGN PATENT DOCUMENTS

| | | | |
|---|---|---|---|
| 525818 | 9/1921 | France | 89/36.02 |
| 2417743 | 9/1979 | France | 273/403 |

OTHER PUBLICATIONS

BowPro; The Ultimate Pellet Trap; Sep. 1984.

*Primary Examiner*—Stephen M. Johnson
*Attorney, Agent, or Firm*—Dean A. Craine

[57] ABSTRACT

An attractive, wall-mounted bullet-proof shield, designed to stop the penetration of a bullet when accidently discharged from a firearm. The bullet-proof shield comprises a back layer made of metallic material, a middle layer made of wood, and a front layer made of plastic, all housed within an outer frame. The shield has an attractive appearance which enables it to be used as a wall hanging or as a piece of furniture. The middle layer is designed to partially absorb the energy of a discharged bullet while the back layer is metallic and designed to stop the penetration of a bullet. The front layer is made of an anti-shattering material designed not to shatter and to prevent wood and metallic particles from rebounding outward toward the user. In one embodiment, the front layer is transparent and an optional aiming sheet is disposed between the outside surface of the wood layer and the inside surface if the front layer. The aiming sheet has targeting indicia printed thereon which reminds the user where to aim the gun towards the center of the shield when cleaning the firearm or loading or unloading bullets.

7 Claims, 1 Drawing Sheet

SINGLE-USE, BULLET-PROOF SHIELD

This is a utility patent application based on a provisional patent application filed on Feb. 3, 1998 (Ser. No. 60/073, 557) now abandoned.

BACKGROUND OF THE INVENTION

1. Field of the Invention

This invention relates to firearm shields and, more particularly, to shield designs that protect against injury or damage caused by accidental discharge of a firearm.

2. Description of the Related Art

Accidental firearm discharges are a common cause of damage to physical property and injuries. Typically, such discharges occur when ammunition is loaded or unloaded from the firearm or when the firearm is being cleaned. When discharges do occur, they often injure individuals located in adjoining rooms when the ammunition travels through walls, floors and ceilings.

What is needed is an attractive, inexpensive bullet-proof shield designed to be used in a building to which the muzzle of the firearm may be pointed when the firearm is being loaded, unloaded or cleaned. Ideally, the shield should be light, capable of being wall-mounted or placed on a dresser or night stand so that it appears as a standard wall hanging or furniture yet sufficiently durable to stop the penetration of a high velocity bullet. The shield also should be inexpensive and designed for single use.

SUMMARY OF THE INVENTION

It is an object of the invention to provide a bullet-proof shield.

It is another object of the invention to provide a shield that is attractive, inexpensive to manufacture and appears as a standard wall hanging.

It is a further object of the invention to provide such a shield that is easy and convenient to use.

These and other objects are met by providing a bullet-proof shield, designed to stop the penetration of a bullet when accidently discharged from a firearm. The bullet-proof shield comprises at least one back, non-penetrable layer, a middle energy-absorbing layer and a front anti-shattering layer all housed within an attractive outer frame. The shield has an attractive appearance which enables it to appear as a typical wall hanging in a building. The back, non-penetrable layer is made of metal sufficiently durable to undergo plastic deformation and to stop the penetration of a high velocity bullet. The middle energy-absorbing layer is made of wood with randomly aligned grain. The front layer is made of anti-shattering, energy-absorbing material designed to prevent the wood and metallic particles from rebounding outward toward the user when an accidental discharge occurs. In one embodiment, the front layer is made of transparent material and has an optional aiming sheet disposed between the outer surface of the wood layer and the inner surface of the front layer. The aiming sheet has targeting indicia printed thereon which directs the user to aim the gun towards the center of the shield when cleaning the firearm or loading or unloading bullets.

DESCRIPTION OF THE PREFERRED EMBODIMENT(S)

Figure 1:
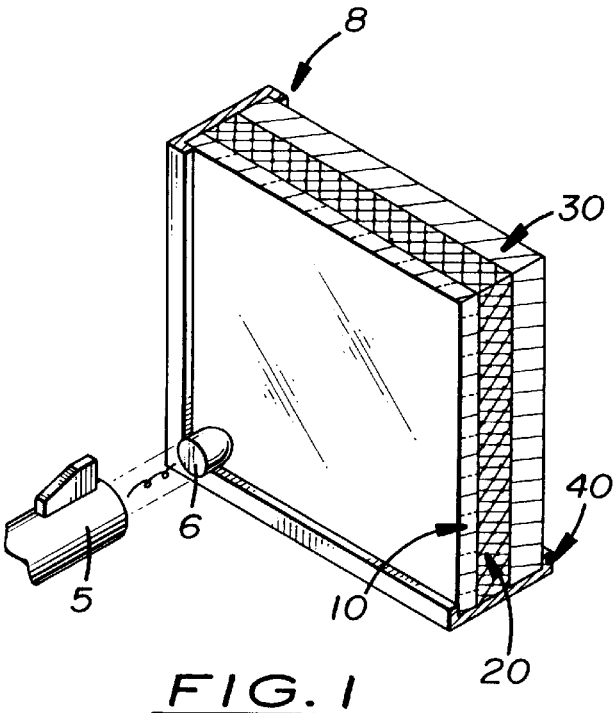
FIG. 1 is a perspective view of the invention disclosed herein.
Figure 2:
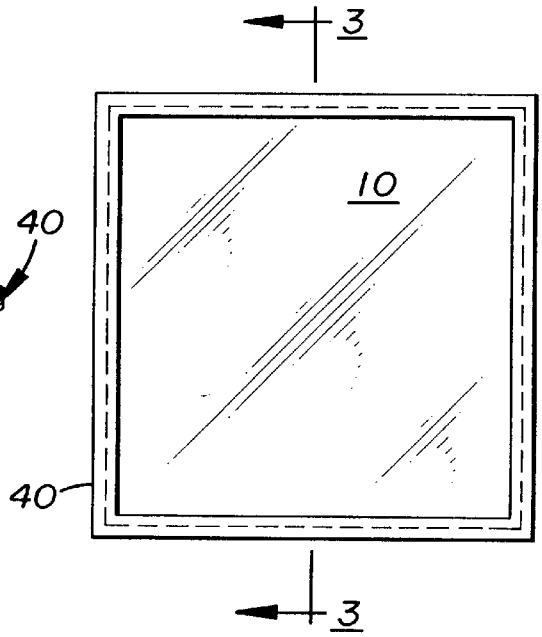
FIG. 2 is a front elevational view of the invention.
Figure 3:
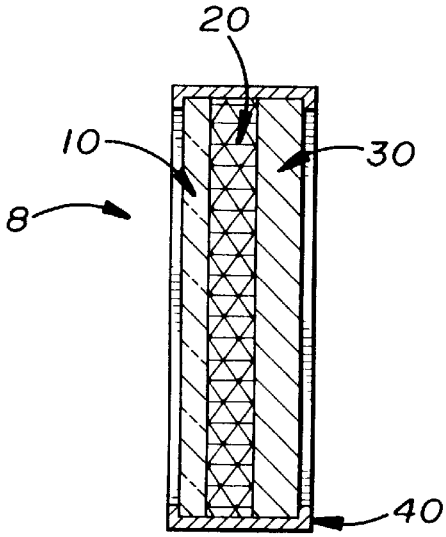
FIG. 3 is a sectional, side elevational view of the invention taken along line 3—3 in FIG. 2.

Shown in the accompanying FIGS. 1–4, there is shown a shield, generally referred to as 8, designed to stop the penetration of a bullet 6 when accidently discharged from a firearm 5. The bullet-proof shield 8 comprises a front layer 10, a middle layer 20, and a back layer 30 all housed within an attractive outer frame 40. The shield 8 has an attractive appearance which enables it to be used as a wall hanging or as a piece of furniture. The middle layer 20 is designed to partially absorb the energy of a high velocity bullet 6 while the back metallic layer 30 is designed to stop the penetration.

Figure 4:
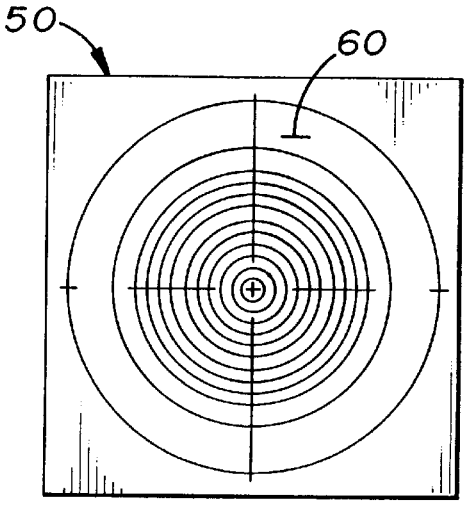
FIG. 4 is a front elevational view of the aiming sheet.

The front layer 10 is made of an energy-absorbing material designed to prevent wood and metallic particles from rebounding outward toward the user when an accidental discharge occurs. In one embodiment, the layer 10 is a sheet of transparent, polycarbonate material approximately one-sixteenth inch thick. As shown in FIG. 4, an optional aiming sheet 50 may be disposed between the outer surface of the middle layer 20 and the inside surface of the front layer 10. The aiming sheet 50 has targeting indicia 60 printed thereon which directs the user to aim the gun towards the center of the shield 8 when cleaning the firearm or loading or unloading bullets. It should be understood that the aiming sheet 50 may be printed directly on the outside surface of the front panel 10.

In the preferred embodiment, the middle layer 20 is made of plywood approximately one-fourth inch thick. Plywood is used because the grain is randomly orientated, thereby making it stronger and a greater energy-absorbing.

In the preferred embodiment, the back material 30 is at least one single sheet of 11 gauge stainless steel which is sufficient to undergo plastic deformation of a 0.45 bullet. In other embodiments, additional sheets of stainless steel may be aligned over the first sheet to provide protection for higher ammunition.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A wall-mounted, bullet-proof shield, comprising:

a. a transparent front layer made of anti-shattering material;

b. a middle layer made of energy-absorbing material disposed adjacent to said front layer;

c. an aiming sheet disposed between said middle layer and said front layer;

d. a back layer made of non-penetrable material disposed adjacent to said middle layer opposite said front layer, said back layer capable of preventing the penetration of a bullet discharged through said front and middle layers; and, e. an outer frame capable of holding said front, middle and back layers in a registered, stacked position.

2. A wall mounted, bullet-proof shield, as recited in claim 1, wherein said back layer is made of stainless steel.

3. A wall mounted, bullet-proof shield, as recited in claim 2, wherein said stainless steel is a single sheet with an 11 gauge thickness.

4. A wall mounted, bullet-proof shield, as recited in claim 1, wherein said middle layer is made of plywood.

5. A wall mounted, bullet-proof shield, as recited in claim 4, wherein said plywood is approximately ¼ inch thick.

6. A wall mounted, bullet-proof shield, as recited in claim 1, wherein said front layer is made of polycarbonate material.

7. A wall mounted, bullet-proof shield, as recited in claim 6, wherein said polycarbonate material is approximately one sixteenth inch thick.

* * * * *